US010492609B2

(12) United States Patent
Zhang

(10) Patent No.: US 10,492,609 B2
(45) Date of Patent: Dec. 3, 2019

(54) MECHANISM TO PREVENT SLIDING FOR CABINET DRAWERS

(71) Applicant: Jiangsu Tongrun Equipment Technology Co., Ltd., Suzhou, Jiangsu (CN)

(72) Inventor: Feng Zhang, Jiangsu (CN)

(73) Assignee: JIANGSU TONGRUN EQUIPMENT TECHNOLOGY CO., LTD., Suzhou, Jiangsu (CN)

( * ) Notice: Subject to any disclaimer, the term of this patent is extended or adjusted under 35 U.S.C. 154(b) by 181 days.

(21) Appl. No.: 15/542,182

(22) PCT Filed: Jul. 3, 2017

(86) PCT No.: PCT/CN2017/091459
§ 371 (c)(1),
(2) Date: Jul. 7, 2017

(87) PCT Pub. No.: WO2018/188201
PCT Pub. Date: Oct. 18, 2018

(65) Prior Publication Data

US 2019/0098997 A1 Apr. 4, 2019

(30) Foreign Application Priority Data

Apr. 11, 2017 (CN) ..... 2017 1 0232493

(51) Int. Cl.
*A47B 88/57* (2017.01)
*A47B 88/49* (2017.01)
(Continued)

(52) U.S. Cl.
CPC ..... *A47B 88/57* (2017.01); *A47B 88/49* (2017.01); *E05B 65/46* (2013.01);
(Continued)

(58) Field of Classification Search
CPC . A47B 88/57; A47B 88/49; A47B 2210/0018; A47B 2210/0024;
(Continued)

(56) References Cited

U.S. PATENT DOCUMENTS 2,436,769 A * 2/1948 Hardie ..... E05C 1/14 292/170
6,851,286 B2 * 2/2005 Dube ..... E05B 65/46 292/336.3

(Continued)

*Primary Examiner* — Daniel J Troy
*Assistant Examiner* — Timothy M Ayres
(74) *Attorney, Agent, or Firm* — Juan Carlos A. Marquez; Marquez IP Law Office, PLLC

(57) ABSTRACT

The present invention discloses a mechanism to prevent sliding for cabinet drawers, comprising a handle component including a handle seat, a handle bar, and pin components; the handle seat being fixed to the drawer, the handle bar being assembled to the handle seat, and the pin components being inserted to two ends of the handle bar and fixed to the drawer. The pin component comprises a pin seat, a pin core, a rocker, and a limit member; the pin core is assembled to the pin seat and slid with respect to the pin seat; the limit member is engaged the tail of the pin core; and the rocker is assembled to pin seat whose bottom portion is attached with the limit member and upper portion is attached with handle bar.

9 Claims, 8 Drawing Sheets

(51) Int. Cl.
*E05B 65/46* (2017.01)
*A47B 95/02* (2006.01)

(52) U.S. Cl.
CPC . *A47B 2095/024* (2013.01); *A47B 2210/0018* (2013.01); *A47B 2210/0024* (2013.01); *A47B 2210/0059* (2013.01); *A47B 2210/0067* (2013.01)

(58) Field of Classification Search
CPC .... A47B 2210/0067; A47B 2210/0059; A47B 2095/024; E05B 65/46
USPC ..... 312/334.4, 332.1
See application file for complete search history.

(56) References Cited

U.S. PATENT DOCUMENTS

| | | | | |
|---|---|---|---|---|
| 9,181,731 | B2 * | 11/2015 | Grela | A47B 81/00 |
| 9,388,609 | B2 * | 7/2016 | Grela | E05C 3/14 |
| 9,717,335 | B2 * | 8/2017 | Zhang | A47B 88/477 |
| 10,004,331 | B2 * | 6/2018 | Jeffries | A47B 95/02 |
| 2015/0327676 | A1 * | 11/2015 | Chang | A47B 95/02 312/319.1 |
| 2016/0128471 | A1 * | 5/2016 | Chang | B25H 3/028 312/249.11 |

* cited by examiner

MECHANISM TO PREVENT SLIDING FOR CABINET DRAWERS

BACKGROUND OF THE INVENTION

1. Technical Field

The present invention relates to position limits for drawers in a cabinet, and more particularly to a mechanism to prevent sliding for cabinet drawers.

2. Description of Related Art

In cabinets equipped with drawers, such as mobile tool cabinets, motor-driven cars and office desks, the drawers when not locked can be drawn out at users' will for convenient use. However, since such a cabinet is typically not provided with a fastening device, its drawers are not resistant to jiggle and tend to unexpectedly slide out under external force. In the event that a drawer has a heavy load therein, such unexpected sliding out can cause turning over of the entire cabinet and incur danger.

For preventing drawers from unexpected sliding out and improving use safety of such drawers, there are two types of fastening means. The first one involves using a key-driven lock to lock drawers, and the second one involves using a keyless, mechanical means for position limit. The first approach is relatively inconvenient for its need a key. The second approach is extensively used for drawer fastening, and there are many known devices commercially available. However, these existing devices have their shortcomings: 1. the fastening mechanisms are structurally complicated and operationally unreliable; and 2. the fastening mechanisms usually have their components assembled piece by piece, but nor modularized, thus making the resulting mechanisms less reliable and making the assembling operation inefficient.

SUMMARY OF THE INVENTION

The present invention is to solve the technical problem of how to provide a mechanism to prevent sliding for cabinet drawers which has a modularize design to easy assembly; its locking mechanism has high reliability; then it can improve the reliability of prevent sliding for cabinet drawers.

To solve the technical problems as mentioned above, the present invention provides a mechanism to prevent sliding for cabinet drawers, comprising a handle component fixed to a drawer, the handle component including a handle bar, a handle seat, and pin components, the handle seat being fixed to the drawer, the handle bar being assembled to the handle seat, the pin components being fixed to a facade of the drawer and to under two ends of the handle bar;

the handle seat including a fixed plate and a rotatory shaft, the fixed plate being fixed to an upper edge of the drawer's facade so that it is perpendicular to the drawer's facade, the rotatory shaft being connected to an outer end of the fixed plate;

the handle bar having a F-shaped section and comprising an upper plate and a lower plate, a circular notch being formed inside of the joint between the upper plate and the lower plate, the circular notch being rotatably mounted around the rotatory shaft of the handle seat;

the pin component comprising a pin seat, a pin core, a rocker, and a limit member, the pin seat being of a T-shaped structure centrally formed with a through hole and composed of a lying cuboid and a standing retaining plate, the cuboid having a fixing ring at its end far away from the retaining plate; the pin core being inserted into the through hole of the pin seat and slidable with respect to the pin seat, with a tail of the pin core jutting out of the pin seat and engaged with the limit member;

wherein the rocker comprises a rocker body and a rotatory shaft; the rotatory shaft is perpendicularly fixed to the center of the rocker body; the rocker body comprises an upper section and a lower section formed on opposite sides of the rotatory shaft, respectively; the rocker is rotatably assembled to the fixing ring by the rotatory shaft;

wherein only the top of the upper section abuts against the inner side of the upper plate of the handle bar and the lower section abuts against the limit member at the side close to the pin seat;

wherein the pin component comprises a spring mounted around the pin core and received in the through hole of the pin seat; and wherein the pin core, the through hole, the spring, the lower section, and the limit member are penetrated by the same axis.

In one embodiment of the mechanism to prevent sliding for cabinet drawers provided by the present invention, wherein the pin component further comprises a spring mounted around the pin core and received in the through hole of the pin seat.

In one embodiment of the mechanism to prevent sliding for cabinet drawers provided by the present invention, wherein the pin component comprises a right pin component and a left pin component assembled to the right and left ends of the handle bar, respectively.

In one embodiment of the mechanism to prevent sliding for cabinet drawers provided by the present invention, wherein the pin component comprises a right pin component and a left pin component assembled to the right and left ends of the handle bar, respectively.

In one embodiment of the mechanism to prevent sliding for cabinet drawers provided by the present invention, wherein the pin core is greater than the pin seat in length, and the through hole of the pin seat is greater than or equal to a head of the pin core in diameter.

In one embodiment of the mechanism to prevent sliding for cabinet drawers provided by the present invention, wherein the pin core is greater than the pin seat in length, and the through hole of the pin seat is greater than or equal to the head of the pin core in diameter.

In one embodiment of the mechanism to prevent sliding for cabinet drawers provided by the present invention, wherein the rocker comprises a rocker body and a rotatory shaft, the rotatory shaft being perpendicularly fixed to a center of the rocker body, the rocker body including an upper section and a lower section, the upper section being of a V-shaped structure gradually narrowed to its end, the lower section having its upper part formed as a straight portion with two parallel opposite sides, and having its lower part formed as a V-shaped structure with its inner side inclined toward its end, an outer side of the upper section and an outer side of the lower section being connected by an arc connection whose inner side is formed as a mirrored S-shaped connection.

In one embodiment of the mechanism to prevent sliding for cabinet drawers provided by the present invention, wherein the rocker has the rotatory shaft inserted into the fixing ring of the pin seat so as to form a center of rotation, and the rocker has a top of the upper section abutting against an inner side of the upper plate and has its lower section abutting against a side of the limit member close to the pin seat.

In one embodiment of the mechanism to prevent sliding for cabinet drawers provided by the present invention, wherein the rotatory shaft of the handle seat is fixedly connected to an outer end of the fixed plate by means of an arc connecting portion.

In one embodiment of the mechanism to prevent sliding for cabinet drawers provided by the present invention, wherein the arc connecting portion is bent while extending toward a top of the drawer's facade.

The present invention has the following beneficial effects. The disclosed mechanism to prevent sliding for cabinet drawers has its pin component made as an independent module to be assembled with a handle bar. This not only structurally simplifies the mechanism to prevent sliding for cabinet drawers and streamlines the assembling operation, but also simplifies the action and enhances reliability of the mechanism to prevent sliding for cabinet drawers, thus being highly marketable.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings.

Figure 1:
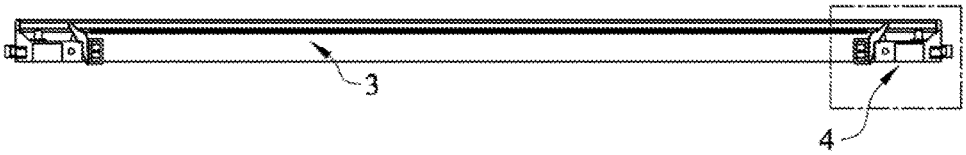
FIG. 1 is a front schematic view of a mechanism to prevent sliding for cabinet drawers according to one preferred embodiment of the present invention when a drawer it is assembled with is closed.
Figure 2:
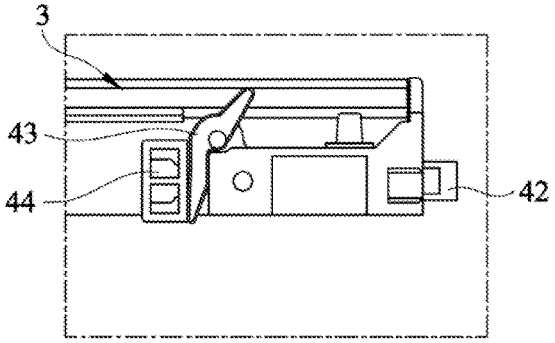
FIG. 2 is a partial, close up view of FIG. 1.
Figure 3:
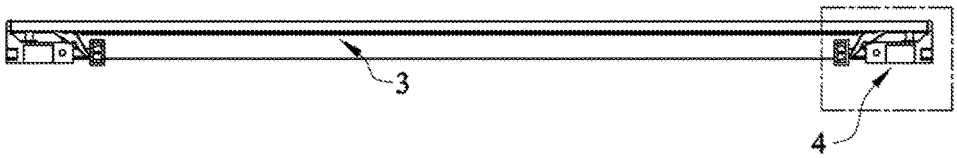
FIG. 3 is a front schematic view of the mechanism to prevent sliding for cabinet drawers when the drawer is open.
Figure 4:
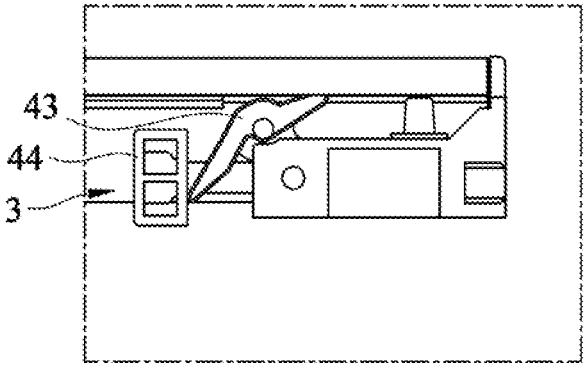
FIG. 4 is a partial, close up view of FIG. 3.
Figure 5:
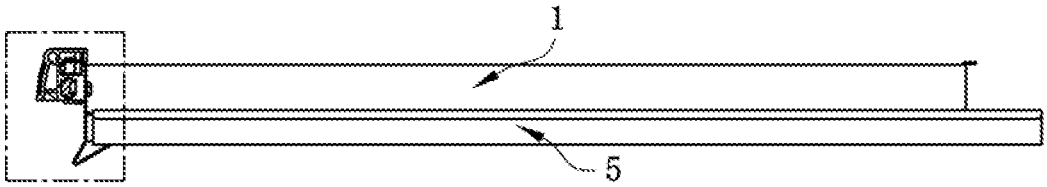
FIG. 5 is a lateral schematic view of the mechanism to prevent sliding for cabinet drawers when the drawer is closed.
Figure 6:
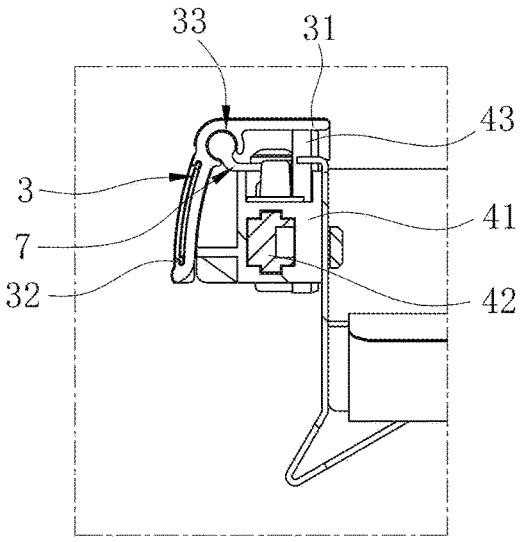
FIG. 6 is a partial, close up view of FIG. 5.
Figure 7:
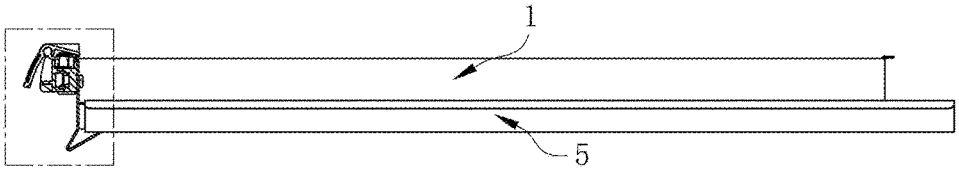
FIG. 7 is a lateral schematic view of the mechanism to prevent sliding for cabinet drawers when the drawer is open.
Figure 8:
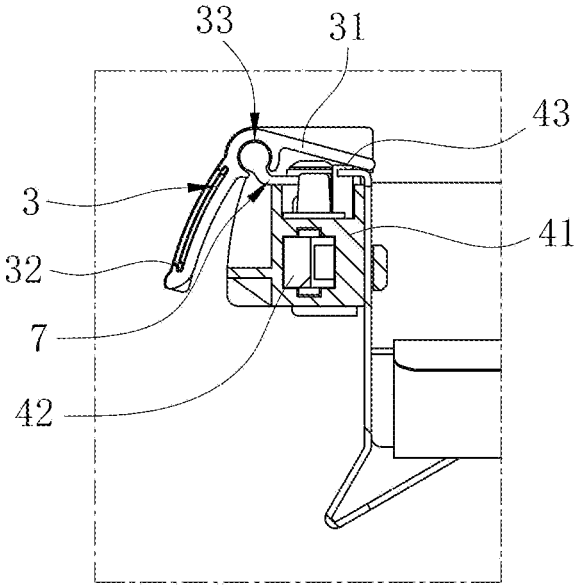
FIG. 8 is a partial, close up view of FIG. 7.
Figure 9:
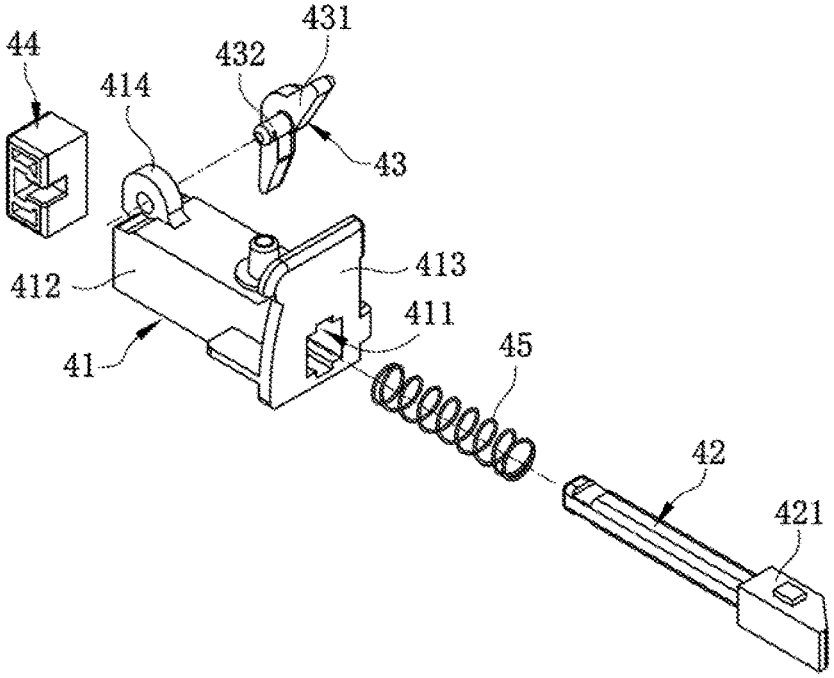
FIG. 9 is an exploded view of the mechanism's pin component.
Figure 10:
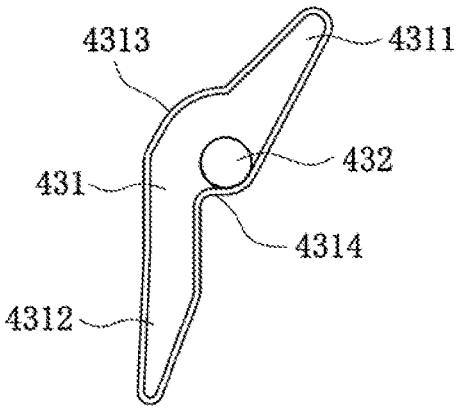
FIG. 10 is a front view of the mechanism's rocker.
Figure 11:
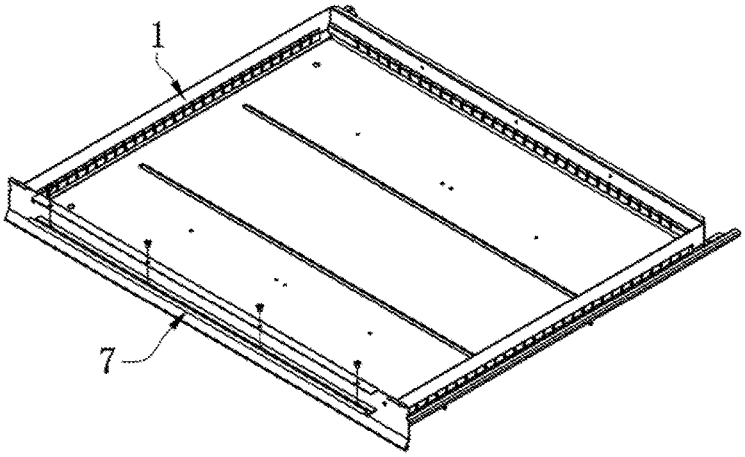
FIG. 11 is a schematic view illustrating assembling operation of the mechanism's handle seat.
Figure 12:
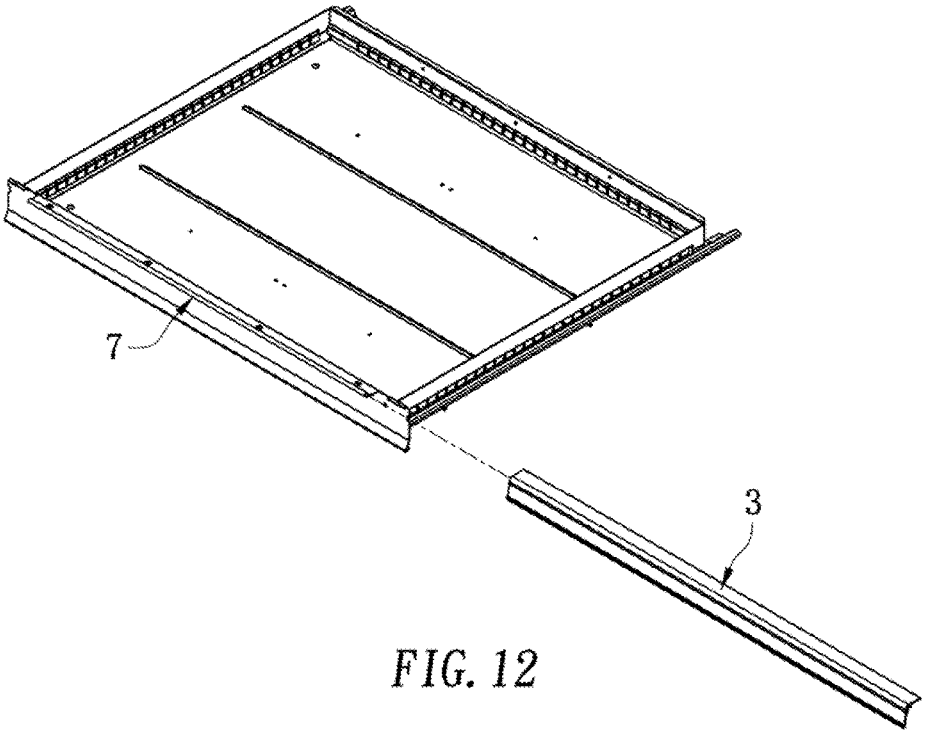
FIG. 12 is a schematic view illustrating assembling operation of the mechanism's handle bar.
Figure 13:
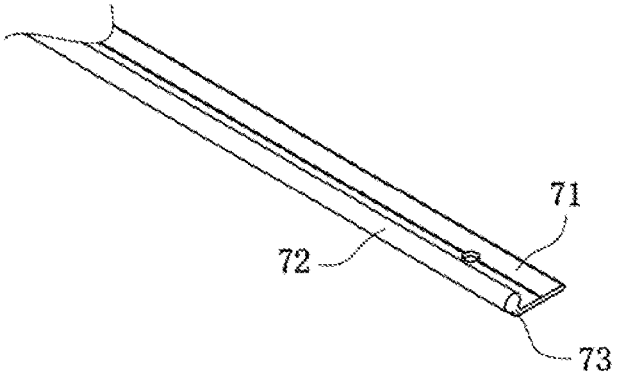
FIG. 13 is a partial schematic view of the handle seat.
Figure 14:
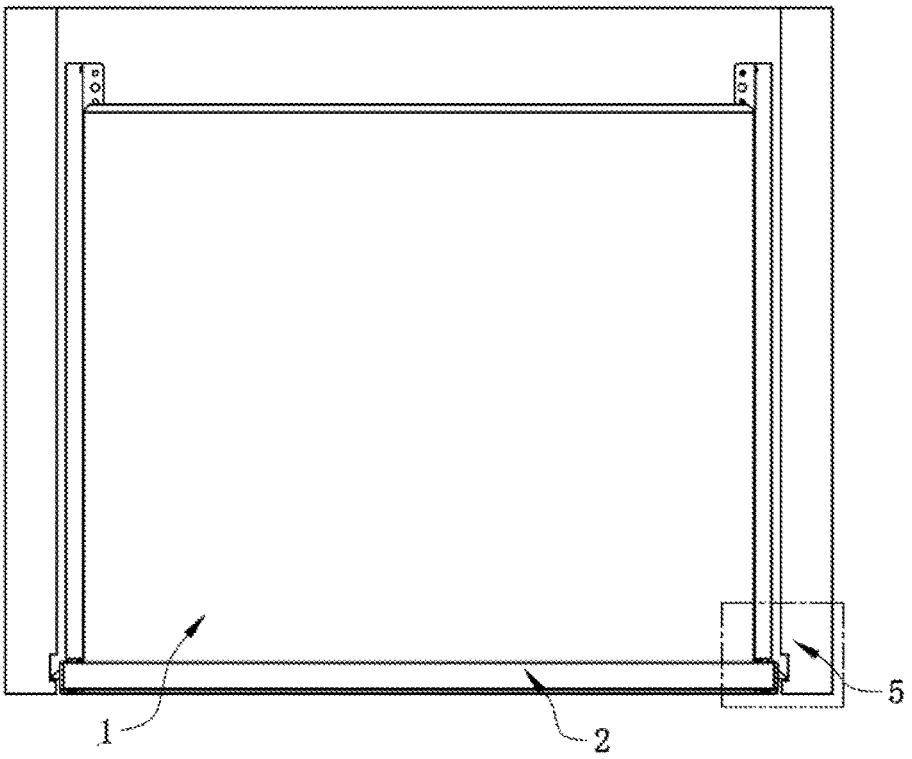
FIG. 14 is a top applied drawing showing the mechanism to prevent sliding for cabinet drawers installed in a cabinet.
Figure 15:
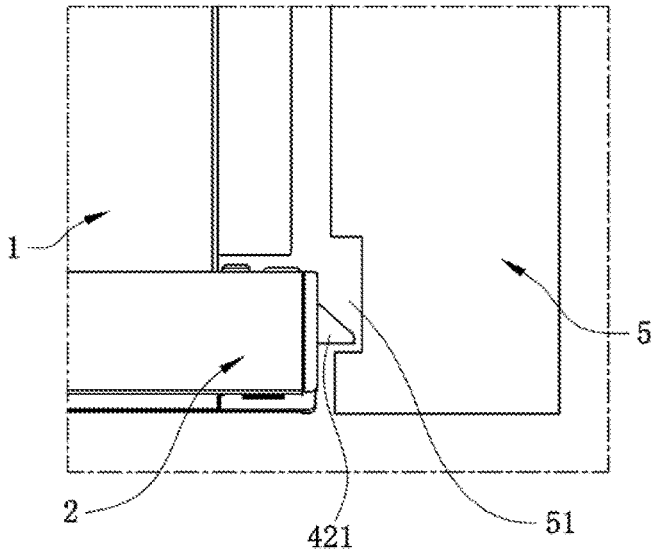
FIG. 15 is a partial, close up view of the drawer of FIG. 13 when closed.
Figure 16:
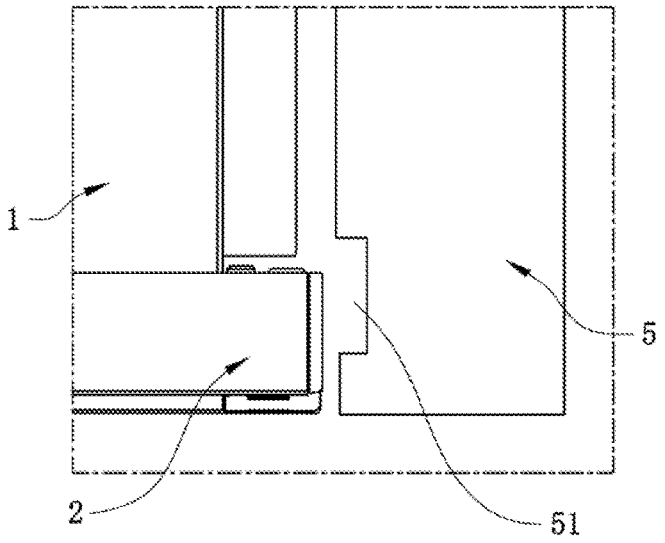
FIG. 16 is a partial, close up view of the drawer of FIG. 15 when being open.

Some embodiments of the present invention are depicted in FIG. 1 through FIG. 16.

It is to be first noted that where the "outer side" is referred to with respect to the rocker's upper section and lower section, it means the side of the rocker far away from the pin seat when the rocker is assembled with the pin seat, and the "inner side" means the side of the rocker close to the pin seat when the rocker is assembled with the pin seat, and is opposite to the outer side.

Embodiment 1

A mechanism to prevent sliding for cabinet drawers comprises a handle component 2 fixed to a drawer body 1. The handle component 2 comprises a handle seat 7, a handle bar 3, and pin components 4.

The handle seat 7 is fixed to the drawer, and comprises a fixed plate 71 and a rotatory shaft 72. The fixed plate 71 is fixed to the upper edge of the drawer's facade so that it is perpendicular to the drawer's facade. The rotatory shaft 72 is connected to the outer end of the fixed plate 71 by means of an arc connecting portion 73, and the arc connecting portion 73 is curved while extending toward the top of the drawer's facade.

The handle bar 3 has a F-shaped section and comprises an upper plate 31 and a lower plate 32. A circular notch 33 is formed at the inside of the joint between the upper plate 31 and the lower plate 32. The circular notch 33 matches the rotatory shaft of the handle seat 7 in size. The handle bar 3 has its circular notch 33 rotatably mounted around the rotatory shaft, thereby getting combined with the handle seat.

There are two pin components 4, namely the right and left pin components that are fixed to the drawer's facade, and fittingly inserted into two ends of the handle bar, so that the handle seat and the handle bar jointly form the handle component.

The handle seat 7 and the pin components 4 are fixed to the drawer body 1 by means of rivets (or any other fixing means known in the art), so as to fix the handle component 2.

The pin component 4 comprises a pin seat 41, a pin core 42, a rocker 43, a limit member 44 and a spring 45.

Therein, the pin seat 41 is of a T-shaped structure centrally formed with a through hole 411, and is composed of a lying cuboid 412 and a standing retaining plate 413. The cuboid 412 has a fixing ring 414 at its end far away from the retaining plate 413.

The pin core 42 is greater than the pin seat 41 in length, and the through hole 411 of the pin seat is greater than or equal to a head 421 of the pin core in diameter. The pin core 42 is inserted into the through hole of the pin seat 41, and is slidable with respect to the pin seat, with a tail of the pin core 42 jutting out of the pin seat 41 and engaged with the limit member 44. The spring 45 is mounted around the pin core and is received in the through hole when installed between the pin core and the pin seat, so that the pin core can be rightly positioned and allowed to sequentially slide.

The rocker 43 comprises a rocker body 431 and a rotatory shaft 432. The rotatory shaft 432 is perpendicularly fixed to the center of the rocker body 431. The rocker body 431 comprises an upper section 4311 and a lower section 4312 formed on opposite sides of the rotatory shaft 432, respectively. The upper section 4311 is of a V-shaped structure gradually narrowed to its end. The lower section 4312 has its upper part formed as a straight portion with two parallel opposite sides, and has its lower part formed as a V-shaped structure with its inner side inclined toward its end. The outer side of the upper section 4311 and the outer side of the lower section 4312 are connected by an arc connection 4313 whose inner side is formed as a mirrored S-shaped connection 4314. The rocker 43 has the rotatory shaft 432 inserted into the fixing ring 414 of the pin seat 41 and is rotatable with respect to the fixing ring. The rocker 43 has the top of the upper section 4311 abutting against the inner side of the upper plate 31 of the handle bar 3, and has the lower section 4312 abutting against the limit member 44 at the side close to the pin seat 41.

The disclosed mechanism to prevent sliding for cabinet drawers is assembled as below:

(1) assembling the pin seat 41, the pin core 42, the rocker 43, the limit member 44, and the spring 45 into the pin component 4;

(2) fixing the handle seat to a drawer body, and rotatably mounting the handle bar to the handle seat;

(3) inserting the pin components into two ends of the handle bar, and fixing the combination to the drawer's facade;

(4) installing the drawer body to a cabinet 5, wherein the cabinet 5 has recesses 51 at its lateral walls at the end of the drawer's drawing direction.

The disclosed mechanism to prevent sliding for cabinet drawers acts as below:

When the drawer is closed, the handle bar's upper plate and the rocker' top abut against each other, with a head of the pin core jutting out of the pin seat's body and received in the recess of the cabinet, thereby preventing the drawer from unexpected sliding out.

To open the drawer, a user can pull the handle bar on the drawer to make it rotate, so that the upper plate of the handle bar presses downward onto the rocker's upper section and makes the rocker rotate, which makes the rocker's lower section push the limit member to slide horizontally, thereby driving the pin core to slide into the pin seat. At this time, the head of the pin core is retracted and leaves from the recess of the cabinet, so that the drawer is allowed to be drawn out.

Embodiment 2

The present embodiment is different from Embodiment 1 for having only one pin component that is located at the right or left end of the handle bar.

The present invention has its pin component made as an independent module to be assembled with a handle bar to form the mechanism to prevent sliding for cabinet drawers. The modularized design thus has the advantages of easy assembling operation, simple action and reliable drawer-fastening capability.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A mechanism to prevent sliding for cabinet drawers, comprising a handle component fixed to a drawer, the handle component including a handle bar, a handle seat, and pin components, the handle seat being fixed to the drawer, the handle bar being assembled to the handle seat, the pin components being fixed to a facade of the drawer and to under two ends of the handle bar;

the handle seat including a fixed plate and a rotatory shaft, the fixed plate being fixed to an upper edge of the drawer's facade so that it is perpendicular to the drawer's facade, the rotatory shaft being connected to an outer end of the fixed plate;

the handle bar having a F-shaped section and comprising an upper plate and a lower plate, a circular notch being formed inside of the joint between the upper plate and the lower plate, the circular notch being rotatably mounted around the rotatory shaft of the handle seat;

the pin component comprising a pin seat, a pin core, a rocker, and a limit member, the pin seat being of a T-shaped structure centrally formed with a through hole and composed of a lying cuboid and a standing retaining plate, the cuboid having a fixing ring at its end far away from the retaining plate; the pin core being inserted into the through hole of the pin seat and slidable with respect to the pin seat, with a tail of the pin core jutting out of the pin seat and engaged with the limit member;

wherein the rocker comprises a rocker body and a rotatory shaft the rotatory shaft is perpendicularly fixed to the center of the rocker body; the rocker body comprises an upper section and a lower section formed on opposite sides of the rotatory shaft, respectively; the rocker is rotatably assembled to the fixing ring by the rotatory shaft;

wherein only the top of the upper section abuts against the inner side of the upper plate of the handle bar and the lower section abuts against the limit member at the side close to the pin seat;

wherein the pin component comprises a spring mounted around the pin core and received in the through hole of the pin seat; and wherein the pin core, the through hole, the spring, the lower section, and the limit member are penetrated by the same axis.

2. The mechanism to prevent sliding for cabinet drawers of claim 1, wherein the pin component comprises a right pin component and a left pin component assembled to the right and left ends of the handle bar, respectively.

3. The mechanism to prevent sliding for cabinet drawers of claim 1, wherein the pin component comprises a right pin component and a left pin component assembled to the right and left ends of the handle bar, respectively.

4. The mechanism to prevent sliding for cabinet drawers of claim 1, wherein the pin core is greater than the pin seat in length, and the through hole of the pin seat is greater than or equal to a head of the pin core in diameter.

5. The mechanism to prevent sliding for cabinet drawers of claim 2, wherein the pin core is greater than the pin seat in length, and the through hole of the pin seat is greater than or equal to a head of the pin core in diameter.

6. The mechanism to prevent sliding for cabinet drawers of claim 1, wherein the upper section being of a V-shaped structure gradually narrowed to its end, the lower section having its upper part formed as a straight portion with two parallel opposite sides, and having its lower part formed as a V-shaped structure with its inner side inclined toward its end, an outer side of the upper section and an outer side of the lower section being connected by an arc connection whose inner side is formed as a mirrored S-shaped connection.

7. The mechanism to prevent sliding for cabinet drawers of claim 6, wherein the rocker has the rotatory shaft inserted into the fixing ring of the pin seat so as to form a center of rotation, and the rocker has a top of the upper section abutting against an inner side of the upper plate and has its lower section abutting against a side of the limit member close to the pin seat.

8. The mechanism to prevent sliding for cabinet drawers of claim 1, wherein the rotatory shaft of the handle seat is fixedly connected to an outer end of the fixed plate by means of an arc connecting portion.

9. The mechanism to prevent sliding for cabinet drawers of claim 8, wherein the arc connecting portion is bent while extending toward a top of the drawer's facade.

* * * * *